US006395816B2

(12) United States Patent
Kataoka

(10) Patent No.: US 6,395,816 B2
(45) Date of Patent: May 28, 2002

(54) RUBBER COMPOUND FOR GOLF BALL AND GOLF BALL USING THE SAME

(75) Inventor: Nobuyuki Kataoka, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/776,670

(22) Filed: Feb. 6, 2001

(30) Foreign Application Priority Data

Feb. 8, 2000 (JP) ..... 2000-030189

(51) Int. Cl.[7] ..... C08K 3/34; C08L 9/00; A63B 37/06

(52) U.S. Cl. ..... 524/450; 473/371; 473/372; 473/373

(58) Field of Search ..... 524/450; 473/371, 473/372, 373

(56) References Cited

U.S. PATENT DOCUMENTS 5,387,637 A * 2/1995 Sullivan
6,325,730 B1 * 12/2001 Binette

* cited by examiner

*Primary Examiner*—David J. Buttner
(74) *Attorney, Agent, or Firm*—Sughrue Mion, PLLC

(57) ABSTRACT

Disclosed are a rubber compound for a golf ball comprising a base rubber, a metal salt of an α,β-unsaturated carboxylic acid, an organic peroxide, and synthetic zeolite, wherein the content of the synthetic zeolite is in a range of 0.1 to 15 parts by weight on the basis of 100 parts by weight of the base rubber, and a golf ball including a center core made from the above rubber compound for a golf ball. The rubber compound is usable for a center core of a solid golf ball or a thread wound golf ball, whereby the initial velocity of the center core can be increased and the degree of freedom in design of the golf ball can be enlarged.

3 Claims, No Drawings

RUBBER COMPOUND FOR GOLF BALL AND GOLF BALL USING THE SAME

BACKGROUND OF THE INVENTION

The present invention relates to a rubber compound for a golf ball, which is used for a solid core or a solid center (hereinafter, generally referred to as "center core") of a solid golf ball or a thread wound golf ball, whereby the initial velocity of the center core can be increased, and to a golf ball including a center core made from the above rubber compound, whereby the degree of freedom in design of the golf ball can be enlarged.

In recent years, golf balls have been variously improved. For example, an attempt has been made to adjust the composition of a material for forming a center core used for a solid golf ball or a thread wound golf ball for the purpose of enhancing the feeling of shooting the golf ball and/or increasing the flying performance of the golf ball.

Such improvements of golf balls, however, have been insufficient yet to satisfy various needs of players, and at present, there have been strong demands toward further improvement of golf balls. In particular, it has been required to develop a material capable of forming a center core having a high repulsion.

In particular, a multi-layer golf ball including a cover having two or more layers different in material from each other has been recently proposed. However, such a multi-layer golf ball has a problem that the degree of freedom in design of the golf ball is limited due to the multi-layer structure when it is used as a competition golf ball in accordance with the golf rule, since the diameter and weight of the golf ball are specified under the golf rule.

SUMMARY OF THE INVENTION

An object of the present invention is to provide a rubber compound for a golf ball, which is used for a center core of a solid golf ball or a thread wound golf ball, whereby the initial velocity of the center core can be increased, and to provide a golf ball including a center core made from the above rubber compound, whereby the degree of freedom in design of the golf ball can be enlarged.

To achieve the above object, the present inventor has made studies on a rubber compound for a golf ball. As the result, it has been found that by incorporating synthetic zeolite into a rubber compound comprising a base rubber, a metal salt of an α,β-unsaturated carboxylic acid and an organic peroxide in an amount of 0.1 to 15 parts by weight on the basis of 100 parts by weight of the base rubber and forming a center core by the rubber compound containing the synthetic zeolite, it is possible to enhance the initial velocity of the center core, although the added amount of the synthetic zeolite is very smaller than that of a usual filler. This may be considered to be due to the fact that the synthetic zeolite suitably captures moisture contained in the center core.

As a result of further study, it has also been found that the center core formed by using the above rubber compound is suitable for a golf ball for competition specified in diameter and weight under a golf rule, and that since the added amount of the filler can be reduced as described above, it is possible to extend the degree of freedom in design of structural parts other than the center core, for example, a cover, and particularly improve the degree of freedom in design of a multi-layer cover, and hence to improve the characteristic of the golf ball.

Accordingly, the present invention provides a rubber compound for a golf ball comprising a base rubber, a metal salt of an α,β-unsaturated carboxylic acid, an organic peroxide, and synthetic zeolite, wherein the content of the synthetic zeolite is in a range of 0.1 to 15 parts by weight on the basis of 100 parts by weight of the base rubber.

The present invention also provides a golf ball comprising a center core and a cover having at least one cover layer, wherein the center core is made from a rubber compound comprising a base rubber, a metal salt of an α,β-unsaturated carboxylic acid, an organic peroxide, and synthetic zeolite, the content of the synthetic zeolite being in a range of 0.1 to 15 parts by weight on the basis of 100 parts by weight of the base rubber.

DETAILED DESCRIPTION OF THE PREFERRED EMBODIMENTS

A rubber compound for a golf ball according to the present invention contains a base rubber, a metal salt of an α,β-unsaturated carboxylic acid, an organic peroxide, and synthetic zeolite.

The function of each component of the rubber compound for a golf ball according to the present invention will be described below.

As the base rubber, there may be used polybutadiene generally used as a material for forming a solid core or a solid center, particularly 1,4-cis-polybutadiene, more preferably 1,4-cis-polybutadiene having a cis-structure of at least 40% or more. In addition, natural rubber, polyisoprene rubber, or styrene-butadiene rubber may be suitably added to the polybutadiene as needed.

As the metal salt of an α,β-unsaturated carboxylic acid, there may be used zinc methacrylate or zinc acrylate. In particular, zinc acrylate is preferably used from the viewpoint of a high repulsion. The added amount of the metal salt of an α,β-unsaturated carboxylic acid may be in a range of 5 to 45 parts by weight, preferably 15 to 30 parts by weight on the basis of the 100 parts by weight of the base rubber.

As the organic peroxide, there may be used 1,1-bis-t-butylperoxy-3,3,5-trimethylcyclohexane, dicumyl peroxide, di(t-butylperoxy)-meta-diisopropylbenzene, and 2,5-dimethyl-2,5-di-t-butylperoxyhexane. The added amount of the organic peroxide may be in a range of 0.2 to 5 parts by weight, preferably 1 to 2 parts by weight on the basis of 100 parts by weight of the base rubber.

The rubber compound for a golf ball according to the present invention contains synthetic zeolite.

The synthetic zeolite may be used in the form of particles having an average particle size in a range of 0.1 to 6 mm, preferably 0.5 to 3 mm. An average diameter of pores of the synthetic zeolite may be in a range of 1 to 10 Å, preferably, 2 to 6 Å. Such synthetic zeolite is commercially available, for example, by Wako Pure Chemical Industries, Ltd. in the trade name of "Molecular Sieve".

The rubber compound for a golf ball according to the present invention is specified such that the added amount of the synthetic zeolite to the base rubber is in a range of 0.1 to 15 parts by weight, preferably 0.5 to 10 parts by weight on the basis of the 100 parts by weight of the base rubber. If the added amount of the synthetic zeolite is less than 0.1 part by weight, the capture of moisture by the synthetic zeolite is insufficient, failing to improve the initial velocity of a center core made from the rubber compound, and if it is more than 15 parts by weight, there occur reductions in repulsion and durability of the center core made from the rubber compound.

It should be noted that in addition to the synthetic zeolite, a known filler, typically an inorganic filler such as zinc oxide or barium sulfate may be added insofar as the added amount does not exert adverse effect on the rubber compound.

A golf ball of the present invention includes a center core made from the above-described rubber compound and a cover having at least one cover layer. The golf ball of the present invention can be applied to a solid golf ball (having a solid core as the center core) and a thread wound golf ball (having a solid center as the center core) insofar as the center core is made from the above-described rubber compound.

The solid golf ball according to the present invention has a solid core made from the above-described rubber compound. The solid core can be produced by a known core production method, for example, a method of kneading respective components for a base rubber, forming a core slug, and vulcanizing it.

In the solid core thus produced, which contains synthetic zeolite in a suitable amount, the amount of moisture in the solid core is suitably adjusted since moisture in the solid core is suitably captured by the synthetic zeolite, resulting in that the initial velocity of the solid core can be improved.

With respect to the solid core thus obtained, the diameter thereof is not particularly limited but may be in a range of 30 to 41 mm, preferably 35 to 39 mm, and the weight thereof may be in a range of 20 to 40 g, preferably 30 to 37 g. If the weight of the solid core is less than 20 g, the hardness thereof becomes insufficient, and if the weight of the solid core is more than 40 g, such a weight may be over the standard of a golf rule.

The hardness of the solid core, which is expressed in deformation under a load of 100 kg, is not particularly limited but may be in a range of 2.0 to 5.0 mm, preferably, 2.5 to 4.0 mm. If the deformation is less than 2.0 mm, the feeling of shooting the ball is degraded, and if the deformation is more than 5.0 mm, the repulsion may be reduced.

According to the golf ball of the present invention, the above-described solid core is covered with a cover having at least one cover layer. Since the added amount of the filler in the solid core is very smaller than that of a conventional filler, a range of the selection of the cover material becomes wider. For example, the specific gravity of the cover can be suitably adjusted and the cover can be made from a combination of different materials. As a result, the degree of freedom in multi-layer structure of the cover can be enlarged. In this way, the golf ball of the present invention can be suitably used as a golf ball including a cover having a multi-layer structure of two or more layers.

The cover can be made from a known cover material, for example, a thermoplastic elastomer such as an ionomer resin, balata rubber, polyurethane based elastomer, polyamide based elastomer, or polyester based elastomer. The cover may be molded by a usual injection molding process.

Even though the cover has a single layer or two or more layers, the thickness of the cover is not particularly limited, but may be in a range of 0.5 to 4 mm, preferably 1.5 to 2.5 mm. If the thickness of the cover is less than 0.5 mm, the durability may be degraded, and if it is more than 4 mm, the repulsion may be reduced.

The golf ball of the present invention is applied to a thread wound golf ball including a solid center made from the above-described rubber compound. The solid center can be produced by the same production method as that used for producing the solid core of the solid golf ball.

With respect to the solid center thus produced, the diameter thereof may be in a range of 25 to 38 mm, preferably 30 to 33 mm, and the weight thereof may be in a range of 15 to 30 g, preferably 20 to 25 g. If the weight is less than 15 g, the flying performance of the ball is reduced, and if the weight is more than 30 g, such a weight may be over the standard of a golf rule.

The hardness of the solid center, which is expressed in deformation under a load of 100 kg, is not particularly limited but may be in a range of 1 to 3 mm, preferably 1.5 to 2 mm. If the deformation is less than 1 mm, the feeling of shooting the ball is degraded, and if the deformation is more than 3 mm, the productivity of the thread wound balls may be degraded.

A thread wound ball can be produced by using the solid center thus produced in accordance with a known method, for example, a method of winding a thread rubber made from polyisoprene by a conventional winding process. The cover can be formed by using the same material as that of the above-described solid golf ball in accordance with the same manner as that used for the above-described solid golf ball.

It should be noted that the golf ball of the present invention can be produced with its diameter and weight specified under a golf rule, specifically, the diameter being in a range of 42.67 to 42.75 mm, and the weight being in a range of 45.2 g to 45.93 g.

As described above, the rubber compound for a golf ball can be used for producing a center core excellent in initial velocity characteristic, and can be used for producing a golf ball capable of improving the degree of freedom in design of the golf ball.

The present invention will be more clearly understood by way of, while not limited thereto, the following examples:

EXAMPLES

The ingredients of a rubber compound having the formulation shown in Table 1 were kneaded by a kneader and compressed at 155° C. for 25 min to obtain a solid core having a diameter of 39.2 mm.

For each solid core thus obtained, the hardness and the initial velocity thereof were examined. The results are shown in Table 1.

Hardness of Core:

The core hardness is expressed in deformation of the solid core under a load of 100 kg. As the hardness value of the solid core becomes larger, the solid core becomes softer.

Initial Velocity of Core:

The initial velocity of the solid core was measured by using an initial velocity meter of the same type as that approved by the authorized organization USGA.

Synthetic Zeolite:

(A): trade name: Synthetic Zeolite 3A (particles) by Wako Pure Chemical Industries, Ltd.

(B): trade name: Molecular Sieve 4A1/8 by Wako Pure chemical Industries, Ltd.

TABLE 1

| Composition | Examples | | | | | | | Comparative Examples | |
|---|---|---|---|---|---|---|---|---|---|
| (parts by weight) | 1 | 2 | 3 | 4 | 5 | 6 | 7 | 1 | 2 |
| 1,4-cis-polybutadiene | 100 | 100 | 100 | 100 | 100 | 100 | 100 | 100 | 100 |
| Zinc acrylate | 23 | 23 | 23 | 23 | 23 | 23 | 23 | 23 | 25 |
| Zinc oxide | 21.5 | 21.5 | 21.5 | 21.5 | 21.5 | 21.5 | 21.5 | 21.5 | 20.6 |
| Dicumyl peroxide | 1 | 1 | 1 | 1 | 1 | 1 | 1 | 1 | 1 |
| Synthetic Zeolite A | 0.5 | 1 | 2 | 5 | 10 | | | | |
| Synthetic Zeolite B | | | | | | 2.5 | 5.0 | | |
| Hardness of core (mm) | 3.17 | 3.14 | 3.07 | 2.96 | 2.72 | 3.01 | 2.99 | 3.31 | 3.10 |
| Initial velocity of core (m/s) | 76.71 | 76.73 | 76.69 | 76.68 | 76.67 | 76.72 | 76.70 | 76.52 | 76.60 |

As is apparent from Table 1, the solid cores in Examples 1 to 7, which are made from the rubber compound for a golf ball according to the present invention, exhibit a high initial velocity.

On the contrary, the solid cores in Comparative Examples 1 and 2 exhibit an initial velocity lower than that of the solid core in Examples 1 to 7.

In particular, as a result of comparison between the solid core in Example 1 and the solid core in Comparative Example 1, which are different only in the presence or absence of the synthetic zeolite, it is found that the initial velocity of the solid core in Example 1 is higher than that of the solid core in Comparative Example 1. Accordingly, it is proved that the addition of the synthetic zeolite in a slight amount specified according to the present invention contributes to improvement of the initial velocity of the solid core.

While the preferred embodiments have been described using the specific terms, such description is for illustrative purposes only, and it is to be understood that changes and modifications may be made without departing from the spirit or scope of the following claims.

What is claimed is:

1. A rubber compound for a golf ball comprising a base rubber, a metal salt of an α,β-unsaturated carboxylic acid, an organic peroxide, and synthetic zeolite, wherein the content of said synthetic zeolite is in a range of 0.1 to 15 parts by weight on the basis of 100 parts by weight of said base rubber.

2. A golf ball comprising a center core and a cover having at least one cover layer, wherein said center core is made from a rubber compound comprising a base rubber, a metal salt of an α,β-unsaturated carboxylic acid, an organic peroxide, and synthetic zeolite, the content of said synthetic zeolite being in a range of 0.1 to 15 parts by weight on the basis of 100 parts by weight of said base rubber.

3. A golf ball according to claim 2, wherein said cover is a multi-layer cover having two or more cover layers.

* * * * *